US011045821B2

(12) United States Patent
Kakuta

(10) Patent No.: US 11,045,821 B2
(45) Date of Patent: Jun. 29, 2021

(54) TRIGGER TYPE LIQUID EJECTOR

(71) Applicant: YOSHINO KOGYOSHO CO., LTD., Tokyo (JP)

(72) Inventor: Yoshiyuki Kakuta, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 134 days.

(21) Appl. No.: 16/499,759

(22) PCT Filed: Apr. 19, 2018

(86) PCT No.: PCT/JP2018/016150
§ 371 (c)(1),
(2) Date: Sep. 30, 2019

(87) PCT Pub. No.: WO2018/194126
PCT Pub. Date: Oct. 25, 2018

(65) Prior Publication Data

US 2020/0030829 A1 Jan. 30, 2020

(30) Foreign Application Priority Data

Apr. 19, 2017 (JP) ..... JP2017-082872

(51) Int. Cl.
*B05B 1/34* (2006.01)
*B05B 11/00* (2006.01)
*F04B 9/14* (2006.01)

(52) U.S. Cl.
CPC ..... *B05B 1/341* (2013.01); *B05B 11/0032* (2013.01); *B05B 11/0067* (2013.01);
(Continued)

(58) Field of Classification Search
CPC . B05B 1/341; B05B 11/0032; B05B 11/0067; B05B 11/3011; B05B 11/3067;
(Continued)

(56) References Cited

U.S. PATENT DOCUMENTS 6,550,694 B1 * 4/2003 Foster ..... B05B 11/3011 222/137
9,033,190 B2 * 5/2015 Alluigi ..... B05B 11/3011 222/383.1

(Continued)

FOREIGN PATENT DOCUMENTS

CN 1137764 A 12/1996
JP H09-164348 A 6/1997

(Continued)

OTHER PUBLICATIONS

Jul. 24, 2018 International Search Report issued in International Patent Application No. PCT/JP2018/016150.

(Continued)

*Primary Examiner* — Frederick C Nicolas
(74) *Attorney, Agent, or Firm* — Oliff PLC

(57) ABSTRACT

A trigger type liquid ejector includes an ejector main body having a vertical supply pipe, an ejection barrel, a trigger mechanism having a main piston and a main cylinder, a reservoir cylinder, a reservoir plunger, a first check valve configured to block communication between a container body and the vertical supply pipe when the main cylinder is pressurized and allow communication when the main cylinder is decompressed, and a second check valve configured to allow communication between an ejection hole and the vertical supply pipe when the main cylinder is pressurized and block communication when the main cylinder is decompressed, and a communication path is provided between the main piston and the main cylinder and is configured to bring the main cylinder in communication with the container body when the main piston is moved to a position deviated rearward from a frontmost position.

4 Claims, 4 Drawing Sheets

(52) U.S. Cl.
CPC ..... *B05B 11/3008* (2013.01); *B05B 11/3011* (2013.01); *B05B 11/3038* (2013.01); *B05B 11/3063* (2013.01); *B05B 11/3067* (2013.01); *B05B 11/3077* (2013.01); *F04B 9/14* (2013.01)

(58) Field of Classification Search
CPC ..... B05B 11/3077; B05B 11/3063; B05B 11/3038; B05B 11/3008; F04B 9/14
See application file for complete search history.

(56) References Cited

U.S. PATENT DOCUMENTS

| | | | | |
|---|---|---|---|---|
| 10,279,363 | B2 * | 5/2019 | Kakuta | B65D 83/00 |
| 2006/0086763 | A1 | 4/2006 | Foster | |
| 2017/0216863 | A1 | 8/2017 | Kakuta et al. | |
| 2018/0264487 | A1 * | 9/2018 | Fujiwara | B05B 1/12 |
| 2018/0369842 | A1 * | 12/2018 | Kakuta | B65D 83/32 |

FOREIGN PATENT DOCUMENTS

| | | | |
|---|---|---|---|
| JP | 2014-166624 | A | 9/2014 |
| JP | 2014-213296 | A | 11/2014 |
| JP | 2016-209785 | A | 12/2016 |
| JP | 2016-221457 | A | 12/2016 |
| JP | 2017-213496 | A | 12/2017 |
| JP | 2017-214076 | A | 12/2017 |
| WO | 2017/111040 | A1 | 6/2017 |

OTHER PUBLICATIONS

Sep. 23, 2020 Office Action issued in Chinese Patent Application No. 201880025679.6.

* cited by examiner

TRIGGER TYPE LIQUID EJECTOR

TECHNICAL FIELD

The present invention relates to a trigger type liquid ejector.

Priority is claimed on Japanese Patent Application No. 2017-082872, filed Apr. 19, 2017, the content of which is incorporated herein by reference.

BACKGROUND ART

A trigger type liquid ejector configured to suction a liquid from a container body and spray (eject) the liquid from a nozzle according to an operation of a trigger extending downward from the nozzle is known.

For example, as disclosed in the following Patent Document 1, there is known a trigger type liquid ejector including a vertical supply pipe configured to suction a liquid in a container body, an ejection barrel extending forward from the vertical supply pipe, a trigger disposed to be movable rearward in a forward bias state and configured to inject the liquid toward an ejection hole through the vertical supply pipe and the ejection barrel according to rearward movement, a main piston that moves forward and rearward according to forward and rearward movement of the trigger, a main cylinder in communication with the vertical supply pipe, the inside of which is pressurized and decompressed according to forward and rearward movement of the main piston, a reservoir cylinder configured to store the liquid passing through the vertical supply pipe and the ejection barrel according to rearward movement of the trigger, and a reservoir plunger accommodated in the reservoir cylinder to be movable rearward in a forward bias state, wherein the reservoir cylinder and the ejection hole come in communication with each other through a communication hole.

In the trigger type liquid ejector, the liquid can be introduced into the reservoir cylinder by moving the trigger rearward. Accordingly, the reservoir plunger can be moved rearward, the liquid can be guided to the ejection hole through the communication hole, and the liquid can be sprayed to the outside through the ejection hole. Accordingly, whenever the trigger is moved rearward, the reservoir plunger can be moved rearward and the reservoir cylinder can be filled with the liquid while spraying the liquid from the ejection hole.

After the reservoir cylinder is filled with the liquid, when an operation of the trigger is stopped, since the reservoir plunger starts to move forward according to forward biasing, the liquid with which the reservoir cylinder is filled can be continuously injected from an injection hole through the communication hole. Accordingly, the liquid can be injected and continuous injection of the liquid can be performed not only when the trigger is operated but also when the trigger is not operated.

The main piston is moved rearward in the main cylinder and the inside of the main cylinder is pressurized according to reward movement of the trigger. Accordingly, the liquid discharged from the main cylinder can be supplied into the reservoir cylinder, and the inside of the reservoir cylinder can be pressurized to move the reservoir plunger rearward against the forward biasing. After that, the main piston that has moved rearward is moved back forward in the main cylinder according to the trigger that is moved forward by the forward biasing. Accordingly, decompression can occur in the main cylinder such that the pressure becomes a negative pressure lower than the pressure in the container body, and the liquid in the container body can be suctioned into the main cylinder through the vertical supply pipe.

DOCUMENT OF RELATED ART

Patent Document

Patent Document 1: Japanese Unexamined Patent Application, First Publication No. 2016-221457

SUMMARY OF INVENTION

Technical Problem

However, in the trigger type liquid ejector of the related art, decompression in the main cylinder may be insufficient, and there is room for improvement.

In consideration of the above-mentioned circumstances, an object of the present invention is directed to providing a trigger type liquid ejector capable of reliably decompressing an inside of a main cylinder.

Solution to Problem

A trigger type liquid ejector according to an aspect of the present invention includes: an ejector main body mounted on a container body in which a liquid is accommodated; and a nozzle member disposed in front of the ejector main body and in which an ejection hole configured to inject the liquid is formed, in which the ejector main body includes: a vertical supply pipe extending in an upward/downward direction and configured to suction the liquid in the container body; an ejection barrel disposed in front of the vertical supply pipe and configured to guide the liquid in the vertical supply pipe into the ejection hole; and a trigger mechanism having a trigger disposed in front of the vertical supply pipe to be movable rearward in a state where the trigger is biased forward, the trigger mechanism being configured to cause the liquid to flow from an inside of the vertical supply pipe toward the ejection hole through an inside of the ejection barrel according to rearward movement of the trigger, in which the trigger mechanism includes: a main piston configured to move forward and rearward in conjunction with movement of the trigger; and a main cylinder inside of which is compressed and decompressed according to movement of the main piston, the inside of the main cylinder coining in communication with the inside of the vertical supply pipe through a communication section, in which the ejector main body includes: a reservoir cylinder into which the liquid passing through the inside of the vertical supply pipe is supplied according to rearward movement of the trigger; a reservoir plunger disposed in the reservoir cylinder to be movable in an axial direction along a central axis thereof, and moving to one side in the axial direction according to supply of the liquid into the reservoir cylinder while being biased toward the other side; a first check valve configured to block communication between an inside of the container body and the inside of the vertical supply pipe when the inside of the main cylinder is pressurized, and allow communication between the inside of the container body and the inside of the vertical supply pipe when the inside of the main cylinder is decompressed; and a second check valve configured to allow communication between the ejection hole and the inside of the vertical supply pipe when the inside of the main cylinder is pressurized, and block communication between the ejection hole and the inside of the vertical supply pipe when the inside of the main cylinder is decompressed, and in which a communication path is provided between the main piston and the main cylinder, the communication path being configured to bring the inside of the main cylinder in communication with the inside of the container body when the main piston is moved to a position deviated rearward from a frontmost position.

When the trigger is mounted on the container body in which the liquid is accommodated and is pulled rearward and moved, the main piston is moved rearward from the frontmost position to pressurize the inside of the main cylinder. Accordingly, the liquid in the main cylinder can be supplied into the vertical supply pipe through the inside of the communication section. Here, the first check valve blocks communication between the inside of the container body and the inside of the vertical supply pipe, and the second check valve allows communication between the ejection hole and the inside of the vertical supply pipe. Accordingly, the liquid supplied into the vertical supply pipe from the inside of the main cylinder can be supplied into the reservoir cylinder through the vertical supply pipe, and the inside of the reservoir cylinder can be pressurized. Accordingly, the reservoir plunger can be pushed toward one side in the axial direction against forward biasing, and the reservoir plunger can be moved toward one side in the axial direction according to supply of the liquid into the reservoir cylinder.

Accordingly, whenever an operation of pulling the trigger is performed, the reservoir plunger can be moved toward one side in the axial direction to store (fill) the liquid in the reservoir cylinder.

Further, since the trigger that has moved rearward is moved forward according to forward biasing, the main piston is accordingly moved back forward in the main cylinder. For this reason, decompression can occur in the main cylinder such that the pressure reaches a negative pressure lower than the pressure in the container body. Here, the first check valve allows communication between the inside of the container body and the inside of the vertical supply pipe, and the second check valve blocks communication between the ejection hole and the inside of the vertical supply pipe. Accordingly, the liquid in the container body can be suctioned into the vertical supply pipe, and introduced into the main cylinder through the communication section. Accordingly, when an operation of pulling the trigger rearward is repeatedly performed, the liquid in the main cylinder can be supplied into the reservoir cylinder while being pressurized, and as described above, the liquid can be stored in the reservoir cylinder while the reservoir plunger is moved to one side in the axial direction.

When an operation of the trigger is stopped after the inside of the reservoir cylinder is filled with the liquid, while supply of the liquid into the reservoir cylinder through the vertical supply pipe is stopped, the reservoir plunger starts to be moved back toward the other side in the axial direction. Accordingly, the liquid with which the inside of the reservoir cylinder is filled can be pushed toward the ejection hole through the ejection barrel from the inside of the reservoir cylinder, and can be injected from the ejection hole. Accordingly, continuous injection of the liquid can be performed.

Moreover, since outflow of the liquid from the inside of the reservoir cylinder toward the vertical supply pipe is restricted by the second check valve during continuous injection of the liquid, for example, the liquid can be injected to the outside from the ejection hole at a high pressure. Accordingly, an injection form of the liquid can be maintained from starting of injection to stopping of the injection, and the liquid can be easily injected in various injection types.

When the reservoir plunger is moved back toward the other side in the axial direction, the reservoir plunger is moved in the reservoir cylinder to the other end in the axial direction if the trigger is not pulled again, but an operation of pulling the trigger may be repeated before that. In this case, the reservoir plunger repeats movement to one side and movement to the other side in the axial direction with a substantially constant width, and gradually moves toward one side in the axial direction as a whole. Accordingly, even in this case, the liquid can be gradually stored in the reservoir cylinder.

In particular, when the main piston is moved rearward according to an operation of the trigger and disposed at a position deviated rearward from the frontmost position, for example at the rearmost position, the inside of the main cylinder can be in communication with the inside of the container body through the communication path. Accordingly, for example, even when air is contained in the liquid suctioned into the main cylinder from the inside of the container body through the vertical supply pipe, the air can be mainly discharged from the inside of the main cylinder according to rearward movement of the main piston, and the air can escape to the inside of the container body through the communication path. Accordingly, the inside of the main cylinder can be reliably decompressed to the extent that the air is discharged according to forward recovery movement of the main piston after that.

Accordingly, when the trigger is operated first from an unused state, some of the air in the main cylinder can be discharged into the container body through the communication path according to an operation of the trigger. Accordingly, the liquid suctioned from the inside of the container body can be stored in the main cylinder while efficiently discharging the air in the main cylinder, and preparation before use can be rapidly completed by performing priming a small number of times.

In addition, after completion of the above-mentioned preparation, the liquid can be efficiently suctioned into the main cylinder from the inside of the container body according to the operation of the trigger, the liquid can be efficiently supplied into the reservoir cylinder according to the operation of the trigger after that, and the inside of the reservoir cylinder can be rapidly pressurized. Accordingly, the inside of the reservoir cylinder can be efficiently filled with the liquid, continuous injection of the liquid can be reliably and rapidly performed while avoiding (minimizing) injection errors, and appropriate injection performance can be obtained.

As described above, since the inside of the main cylinder can be reliably decompressed, reduction in the number of times priming is performed, avoidance of injection errors, and so on can be achieved, and it is possible to provide a trigger type liquid ejector with high quality that can be easily used and has improved convenience.

The ejector main body may include an accumulator valve configured to pressurize the liquid, and open to supply the pressurized liquid toward the ejection hole when a pressure of the liquid reaches a predetermined value.

In this case, since the accumulator valve is provided, the pressurized liquid can be injected from the ejection hole. Accordingly, for example, the liquid can be prevented from being immediately injected from the ejection hole by the operation of the trigger, and the liquid can be injected at an appropriate pressure (injection pressure). Accordingly, for example, even in the case other than continuous injection, injection can be performed in an appropriate injection state by the operation of the trigger. In addition, for example, during storage or the like, since a flow of the low pressure liquid toward the ejection hole can be restricted by the accumulator valve, leakage of the liquid from the ejection hole can be minimized.

A piston guide with which the main piston closely slides may be formed in the main cylinder, and the communication path may be configured to bring the inside of the main cylinder in communication with the inside of the container body through a space between an inner circumferential surface of the main piston and an outer circumferential surface of the piston guide and an inside of the piston guide.

In this case, since movement of the main piston can be guided using the piston guide, the main piston can be easily and smoothly moved with little rattling. Accordingly, operability of the trigger can be improved, and injection of the liquid can be smoothly performed. In addition, since the communication path can be formed using the space between the main piston and the piston guide and the inside of the piston guide, the communication path can be easily and conveniently formed.

A lip section in close sliding contact with the outer circumferential surface of the piston guide may be formed on the main piston, a recessed section recessed toward an inner side of the piston guide and configured to accommodate the lip section may be formed in a portion of the outer circumferential surface of the piston guide facing the lip section in a radial direction of the piston guide when the main piston is disposed at a rearmost position, and the communication path may be configured to bring an inside of the main piston in communication with the inside of the piston guide through a gap between the lip section and the recessed section.

In this case, when the main piston is moved from the frontmost position to the rearmost position according to the operation of the trigger, the lip section is accommodated in the recessed section. Accordingly, the air in the main cylinder can be discharged through the gap between the lip section and the recessed section, and the air can escape to the inside of the container body through the communication path. In addition, since the lip section is accommodated in the recessed section when the main piston is disposed at the rearmost position, the air can be discharged from the inside of the main cylinder in a final stage while substantially the entire liquid in the main cylinder is supplied into the vertical supply pipe. Accordingly, both of appropriate supply of the liquid from the inside of the main cylinder into the vertical supply pipe and appropriate discharge of the air from the inside of the main cylinder can be more stably and reliably performed.

Advantageous Effects of Invention

According to the present invention, since the inside of the main cylinder can be reliably decompressed, reduction in the number of times priming is performed, avoidance of injection errors, and so on can be achieved, and it is possible to provide a trigger type liquid ejector with high quality that can be easily used and has improved convenience.

DESCRIPTION OF EMBODIMENTS

Hereinafter, an embodiment of a trigger type liquid ejector according to the present invention will be described with reference to the accompanying drawings.

Figure 1:
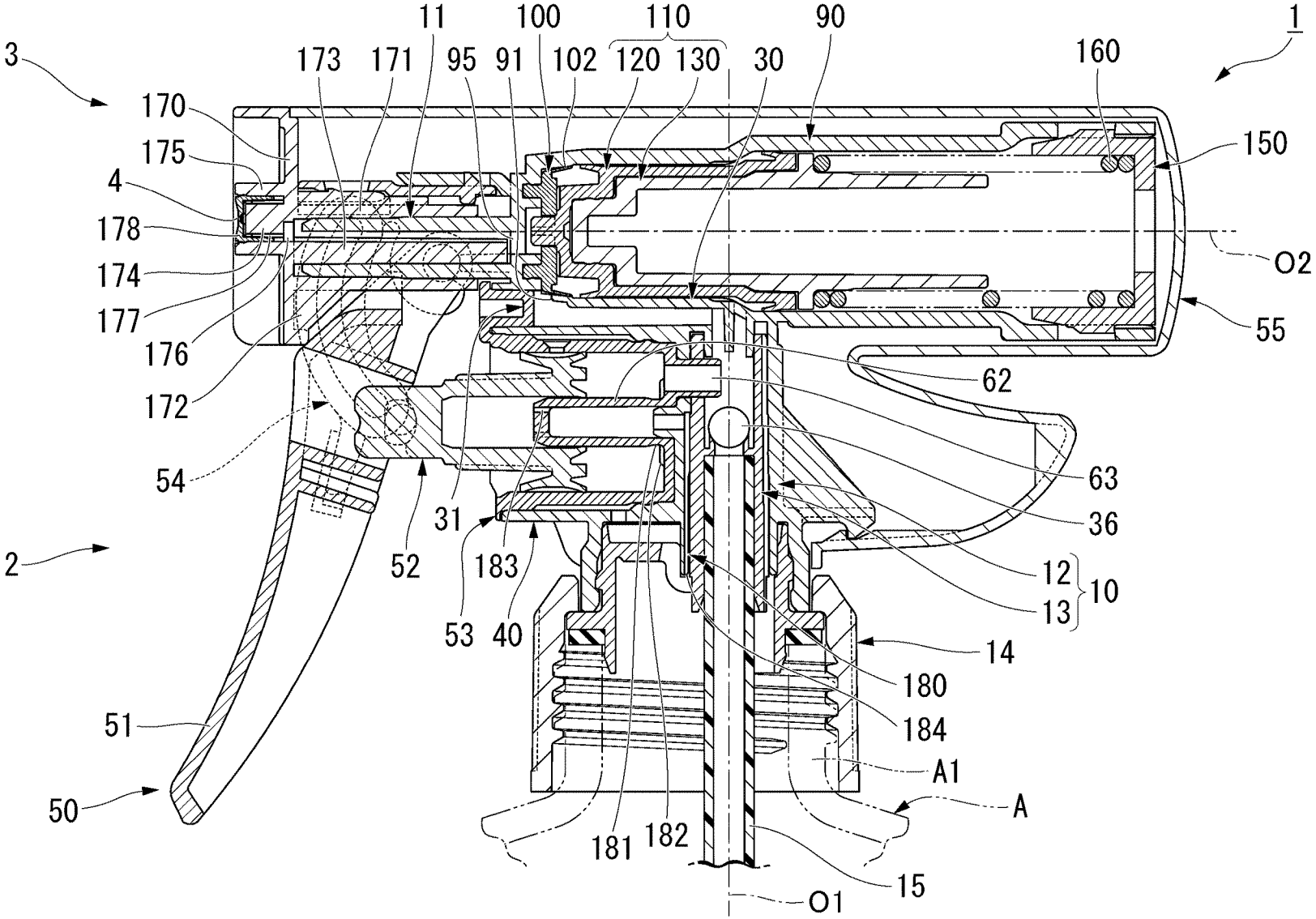
FIG. 1 is a longitudinal cross-sectional view showing an embodiment of a trigger type liquid ejector according to the present invention.

As shown in FIG. 1, a trigger type liquid ejector 1 of the embodiment includes an ejector main body 2 mounted on a container body A that accommodates a liquid and having a vertical supply pipe 10 configured to suction the liquid, and a nozzle member 3 having an ejection hole 4 configured to spray the liquid forward and mounted on the ejector main body 2.

Further, each configuration of the trigger type liquid ejector 1 is a molded article formed of a synthetic resin unless the context clearly indicates otherwise.

In the embodiment, a central axis of the vertical supply pipe 10 is referred to as an axis O1, a side of the container body A along the axis O1 is referred to as a lower side, an opposite side thereof is referred to as an upper side, and a direction along the axis O1 is referred to as an upward/downward direction. In addition, in a plan view seen in the upward/downward direction, one direction perpendicular to the axis O1 is referred to as a forward/rearward direction, and a direction perpendicular to both of the upward/downward direction and the forward/rearward direction is referred to as a leftward/rightward direction.

The ejector main body 2 includes the vertical supply pipe 10 extending in the upward/downward direction, and an ejection barrel 11 extending from the vertical supply pipe 10 in the forward/rearward direction and in communication with the vertical supply pipe 10. Further, the ejector main body 2 includes a connecting tube section 30, a closing-off plug 31, a ball valve (a first check valve) 36, a tube section 40 for a cylinder, a reservoir cylinder 90, a reservoir valve (a second check valve) 102 and a reservoir plunger 110.

Further, in the forward/rearward direction, a direction in which the ejection barrel 11 extends from the vertical supply pipe 10 is referred to as a front side or a forward direction, and an opposite direction thereof is referred to as a rear side or a rearward direction.

Figure 2:
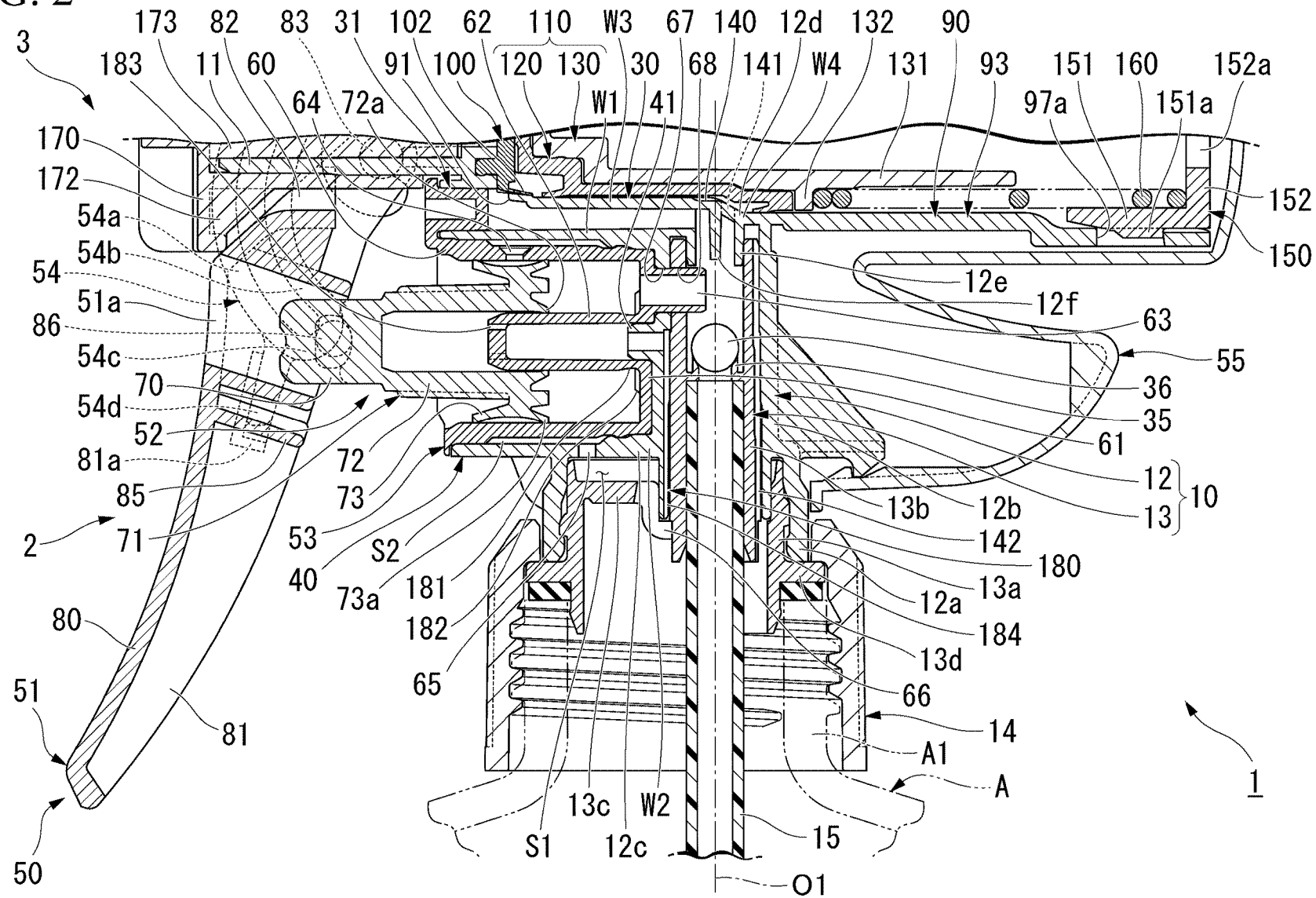
FIG. 2 is an enlarged longitudinal cross-sectional view of a periphery of a vertical supply pipe according to the trigger type liquid ejector shown in FIG. 1.

As shown in FIGS. 1 and 2, the vertical supply pipe 10 includes an outer tube 12 having a topped tubular shape, and an inner tube 13 fitted into the outer tube 12.

The outer tube 12 includes a large diameter section 12*a*, a small diameter section 12*b* disposed above the large diameter section 12*a* and having a diameter smaller than that of the large diameter section 12*a*, and a flange section 12*c* configured to connect an upper end portion of the large diameter section 12*a* and a lower end portion of the small diameter section 12*b*, and is formed in a two-stage tube shape having a diameter reduced from below toward above. Further, an upper opening section of the small diameter section 12*b* is covered with a top wall section 12*d*.

A seal tube section 12*e* and a restricting protrusion 12*f* which extend downward are formed on the top wall section 12*d*. Both of the seal tube section 12*e* and the restricting protrusion 12*f* are disposed coaxially with the axis O1.

Further, the seal tube section 12*e* is formed to surround the restricting protrusion 12*f* from an outer side in the radial direction, and extends downward to substantially the same length as that of the restricting protrusion 12*f*.

The inner tube 13 includes a large diameter section 13*a*, a small diameter section 13*b* disposed above the large diameter section 13*a* and having a diameter smaller than that of the large diameter section 13*a*, and a flange section 13*c* configured to connect an upper end portion of the large diameter section 13*a* and a lower end portion of the small diameter section 13*b*, and formed in a two-stage tube shape having a diameter reduced from below toward above.

The seal tube section 12*e* of the outer tube 12 is fitted into an upper end portion of the small diameter section 13*b* of the inner tube 13. In addition, an upper section of a pipe 15 disposed in the container body A and having a lower end opening located at a bottom section (not shown) of the container body A is fitted into the small diameter section 13*b*. The flange section 13*c* of the inner tube 13 is disposed below the flange section 12*c* of the outer tube 12 in a state in which a gap S1 is secured between the flange section 13*c* of the inner tube 13 and the flange section 12*c* of the outer tube 12.

An annular brim section 13*d* protruding outward in the radial direction is formed on a portion of the large diameter section 13*a* of the inner tube 13 protruding downward from the large diameter section 12*a* of the outer tube 12. The brim section 13*d* is disposed in an upper end portion of a mounting cap 14 mounted (for example, screwed) on a mouth section A1 of the container body A, and rotatably locks an upper end portion of the mounting cap 14 around the axis thereof.

The brim section 13*d* is sandwiched between the mounting cap 14 and an upper end opening edge in the mouth section A1 of the container body A in the upward/downward direction.

The axis O1 of the vertical supply pipe 10 constituted by the outer tube 12 and the inner tube 13 is eccentric rearward with respect to a container axis of the container body A.

A support tube section 35 formed in a tubular shape having a diameter smaller than that of the inner tube 13 and configured to support the ball valve 36 from below is disposed on a portion of an inner circumferential surface of the inner tube 13 below the seal tube section 12*e* and above an upper end of the pipe 15.

The support tube section 35 is disposed coaxially with the axis O1, and a lower end portion thereof protrudes outward in the radial direction to be formed integrally with an inner circumferential surface of the inner tube 13. An upper opening end of the support tube section 35 becomes a seating surface on which the ball valve 36 seats, and is formed in a tapered cross-sectional shape.

The ball valve 36 is disposed inside the inner tube 13 in a state in which the ball valve 36 is separably seated on the seating surface of the support tube section 35. The ball valve 36 brings a space in the inner tube 13 disposed above the support tube section 35 and a space in the inner tube 13 disposed below the support tube section 35 in communication with each other and blocks communication between these spaces.

The connecting tube section 30 extends forward from the upper end portion of the vertical supply pipe 10. Specifically, a rear end portion of the connecting tube section 30 is connected to a front side of an upper end portion in the small diameter section 12*b* of the outer tube 12. A rear end opening of the connecting tube section 30 is open in the seal tube section 12*e*. Accordingly, the connecting tube section 30 is in communication with the vertical supply pipe 10.

The closing-off plug 31 closely fitted into the connecting tube section 30 and configured to close a front end opening of the connecting tube section 30 is provided on a front end portion of the connecting tube section 30.

The tube section 40 for a cylinder is formed integrally with a portion of the outer tube 12 disposed below the connecting tube section 30. The tube section 40 for a cylinder is open forward while protruding forward from the outer tube 12. The tube section 40 for a cylinder is disposed between the connecting tube section 30 and the flange section 12*c*, has a common partition wall W1 shared with the connecting tube section 30, and has a common partition wall W2 shared with the flange section 12*c*.

Figure 3:
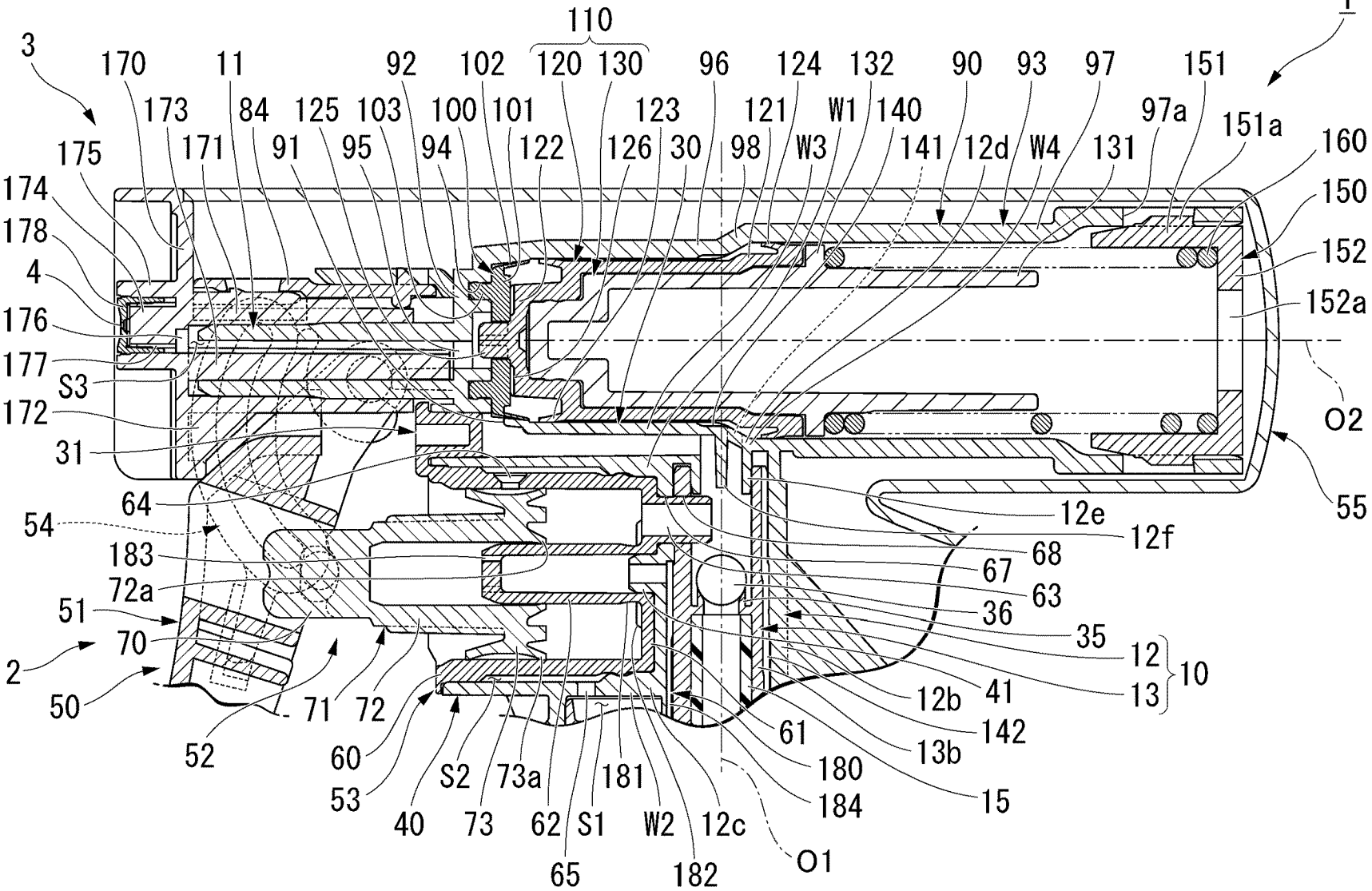
FIG. 3 is an enlarged longitudinal cross-sectional view of a periphery of a reservoir plunger according to the trigger type liquid ejector shown in FIG. 1.

As shown in FIGS. 1 and 3, the reservoir cylinder 90 is disposed above the connecting tube section 30, and the liquid passing through the vertical supply pipe 10 and the connecting tube section 30 is supplied into the reservoir cylinder 90 according to rearward swinging (movement) of a trigger 51 (to be described below).

The reservoir cylinder 90 is formed in a tubular shape extending in the forward/rearward direction, and disposed parallel to the connecting tube section 30 and the tube section 40 for a cylinder. In the drawings, the reservoir cylinder 90 is formed to protrude rearward from the vertical supply pipe 10. Further, a central axis of the reservoir cylinder 90 extends in the forward/rearward direction. Hereinafter, a central axis of the reservoir cylinder 90 is referred to as an axis O2.

A supply hole 91 in communication with the connecting tube section 30 is formed in the reservoir cylinder 90. Accordingly, the liquid passing through the vertical supply pipe 10 and the connecting tube section 30 is supplied into the reservoir cylinder 90 through the supply hole 91.

The connecting tube section 30 and the reservoir cylinder 90 are disposed parallel to each other in the upward/downward direction, and include a common partition wall W3. In the drawings, the reservoir cylinder 90 is disposed above the vertical supply pipe 10. For this reason, the vertical supply pipe 10 and the reservoir cylinder 90 include a common partition wall W4 formed by the top wall section 12*d*.

The reservoir cylinder 90 includes a front wall section 92 disposed above a front end portion of the connecting tube section 30, and a cylinder tube 93 extending rearward from the front wall section 92, and is formed in a tubular shape that opens rearward as a whole.

A mounting concave section 94 and a communication hole 95 are formed in the front wall section 92.

The mounting concave section 94 is formed on a rear end surface of the front wall section 92 in an annular shape coaxial with the axis O2 of the reservoir cylinder 90. The communication hole 95 is formed to pass through the front wall section 92 in the forward/rearward direction. The communication hole 95 is disposed inside the mounting concave section 94 and passes through the front wall section 92 in the forward/rearward direction when the front wall section 92 is seen in a front view in the forward/rearward direction.

The cylinder tube 93 includes a front tube section 96 connected to the front wall section 92, a rear tube section 97 having an outer diameter and an inner diameter larger than those of the front tube section 96 and disposed behind the front tube section 96, and a stepped section 98 configured to connect the front tube section 96 and the rear tube section 97 in the forward/rearward direction, and is formed in a multi-stage tubular shape having a diameter that is gradually increased from a front side toward a rear side.

The stepped section 98 has a diameter that is gradually increased from a front side toward a rear side. The rear tube section 97 is disposed behind the vertical supply pipe 10. A plurality of locking concave sections 97*a* are formed on a rear end portion side of the rear tube section 97 at intervals in the circumferential direction of the rear tube section 97. In the drawings, the locking concave sections 97*a* are formed to pass through the rear tube section 97 in the radial direction.

However, the locking concave section 97*a* may not be a through-hole, and for example, may be a concave section (a recessed section) formed in an inner circumferential surface of the rear tube section 97.

Further, the front tube section 96 constitutes the partition wall W3. Then, a rear end portion of the front tube section 96, the stepped section 98, and a front end portion of the rear tube section 97 constitute the partition wall W4.

In addition to the supply hole 91, a communicating groove 140 and a collecting hole 141 are further formed in the cylinder tube 93.

The supply hole 91 is formed in a lower portion of a front end portion in the front tube section 96, and passes through the partition wall W3 in the upward/downward direction. The communicating groove 140 is formed in an inner circumferential surface of a rear end portion in the front tube section 96. The communicating groove 140 is open rearward while extending in the forward/rearward direction. In the drawings, the plurality of communicating grooves 140 are formed around the axis O2 at intervals.

The collecting hole 141 is formed in the stepped section 98 and passes through the partition wall W4 in the upward/downward direction. Specifically, the collecting hole 141 is formed to be disposed between the seal tube section 12*e* and the small diameter section 12*b* of the outer tube 12 when seen in a direction of the axis O1.

As shown in FIGS. 2 and 3, a collecting passage 142 in communication with the collecting hole 141 and crossing the vertical supply pipe 10 in the upward/downward direction is formed in the vertical supply pipe 10. The collecting passage 142 is formed in a longitudinal groove shape in the outer circumferential surface of the inner tube 13, and passes through the small diameter section 13*b* in the upward/downward direction to come in communication with the large diameter section 13*a*. Accordingly, the collecting passage 142 comes in communication with the collecting hole 141 and the container body A.

As shown in FIGS. 1 and 3, a valve body 100 in which the reservoir valve 102 is formed is disposed in the reservoir cylinder 90.

The reservoir valve 102 is a check valve configured to allow supply of a liquid into the reservoir cylinder 90 from the connecting tube section 30 through the supply hole 91 and restrict outflow of the liquid from the reservoir cylinder 90 through the supply hole 91 into the connecting tube section 30. That is, the reservoir valve 102 is a check valve configured to allow communication between the ejection hole 4 and the vertical supply pipe 10 during pressurization in a main cylinder 53 (to be described below) and block communication between the ejection hole 4 and the vertical supply pipe 10 during decompression in the main cylinder 53.

The valve body 100 includes a valve base section 101 and the reservoir valve 102.

The valve base section 101 is formed in an annular shape coaxial with the axis O2 and disposed on a rear end surface side of the front wall section 92. The valve base section 101 includes a mounting convex section 103 protruding forward and mounted in the mounting concave section 94 by entering the mounting concave section 94 from behind. Accordingly, the entire valve body 100 is assembled integrally with the front wall section 92.

The reservoir valve 102 is formed in an annular shape protruding rearward from an outer circumferential edge portion of the valve base section 101. The reservoir valve 102 is elastically deformable in the radial direction of the reservoir cylinder 90, and a rear end portion of the reservoir valve 102 that is a free end separably seats on the inner circumferential surface of the cylinder tube 93. The rear end portion of the reservoir valve 102 is disposed behind the supply hole 91. Accordingly, the reservoir valve 102 openably closes the supply hole 91 from the inside of the reservoir cylinder 90.

The reservoir plunger 110 is accommodated in the reservoir cylinder 90, and the reservoir plunger 110 is disposed to be movably in the forward/rearward direction (the axial direction) along the axis O2 and moves rearward (one side in the axial direction) according to supply of the liquid into the reservoir cylinder 90.

The reservoir plunger 110 includes a sliding member 120 sliding in the reservoir cylinder 90 in the forward/rearward direction, and a receiving member 130 fitted into the sliding member 120. The sliding member 120 and the receiving member 130 are formed in a tubular shape extending in the forward/rearward direction, and disposed coaxially with the axis O2.

For example, the sliding member 120 includes a plunger tube 121 formed of a material softer than the receiving member 130 and extending in the forward/rearward direction, and a closing wall 122 configured to close a front end opening of the plunger tube 121.

The plunger tube 121 is formed in a multi-stage tubular shape having a diameter that is gradually increased from a front side toward a rear side. A first lip section 123 and a second lip section 124 are formed on the outer circumferential surface of the plunger tube 121 throughout the circumference of the plunger tube 121 in the circumferential direction.

The first lip section 123 and the second lip section 124 are disposed at an interval in the forward/rearward direction, and closely slide on the inner circumferential surface of the cylinder tube 93 in the forward/rearward direction.

Specifically, the first lip section 123 slides on the inner circumferential surface of the front tube section 96, and the second lip section 124 slides on the inner circumferential surface of the rear tube section 97. Further, the first lip section 123 is in close sliding contact with the inner circumferential surface of the front tube section 96. Accordingly, sealability is secured between the first lip section 123 and the inner circumferential surface of the front tube section 96. Similarly, the second lip section 124 is in close sliding contact with the inner circumferential surface of the rear tube section 97. Accordingly, sealability is secured between the second lip section 124 and the inner circumferential surface of the rear tube section 97.

A front end surface of the closing wall 122 separably seats on the rear end surface of the valve base section 101 from behind. Accordingly, the closing wall 122 openably closes the communication hole 95.

In particular, the closing wall 122 is biased forward by an elastic recovering force (a spring force) of a coil spring 160 (to be described below), and strongly pressed on the rear end surface of the valve base section 101 from behind.

Accordingly, the closing wall 122 seals the communication hole 95, and is opened to open the communication hole 95 when the entire reservoir plunger 110 is moved rearward against the coil spring 160. Accordingly, the closing wall 122 functions as an accumulator valve that can pressure the liquid in the reservoir cylinder 90 until the reservoir plunger 110 is moved rearward, and open a valve to supply the pressurized liquid toward the ejection hole 4 when a pressure of the liquid reaches a predetermined value, i.e., when the reservoir plunger 110 is moved rearward against the coil spring 160.

The closing wall 122 of the embodiment is disposed closer to the ejection hole 4 than the reservoir valve 102, and opens the valve with a working pressure (a valve opening pressure) corresponding to an elastic recovering force (a spring force) of the coil spring 160. A working pressure of the closing wall 122 is higher than a working pressure when the reservoir valve 102 is open.

A convex section 125 and a concave groove 126 are formed in the front end surface of the closing wall 122. The convex section 125 protrudes forward from the closing wall 122, and enters the annular valve base section 101 from behind. The concave groove 126 extends in the radial direction of the reservoir plunger 110, and is open outward in the radial direction.

When the front end surface of the closing wall 122 seats on (abuts) the rear end surface of the valve base section 101, communication between the concave groove 126 and the communication hole 95 is blocked.

The receiving member 130 includes a receiving tube 131 disposed inside the plunger tube 121 and having a topped tubular shape, a front end opening of which is closed, and an annular receiving seat section 132 protruding from a portion of the receiving tube 131 behind the plunger tube 121 outward in the radial direction of the receiving tube 131 and coining in contact with a rear end portion of the plunger tube 121 from behind.

The receiving tube 131 extends rearward from a rear end portion of the plunger tube 121. Accordingly, an annular gap is formed between the receiving tube 131 and the rear tube section 97 of the cylinder tube 93.

The coil spring 160 (to be described below) is attached using the annular gap.

A cap 150 is mounted on a rear end portion of the reservoir cylinder 90.

The cap 150 includes a cap tube 151 disposed coaxially with the axis O2 and fitted into the rear tube section 97 of the cylinder tube 93, and a cap wall 152 configured to cover a rear opening section of the cap tube 151.

A plurality of locking protrusion sections 151*a* protruding outward in the radial direction of the cap tube 151 are formed on the outer circumferential surface of the cap tube 151 at intervals in the circumferential direction of the cap tube 151. The locking protrusion sections 151*a* enter the locking concave sections 97*a* formed in the rear tube section 97, and are locked to the locking concave sections 97*a* from the front. Accordingly, the cap 150 is assembled to the reservoir cylinder 90 while being retained to the rear.

An air hole 152*a* configured to bring the inside and the outside of the reservoir cylinder 90 in communication with each other is formed in the central section of the cap wall 152.

The coil spring 160 formed of, for example, a metal material is disposed between the reservoir plunger 110 and the cap 150 in a compressed state.

The coil spring 160 is disposed to surround a rear end portion of the plunger tube 121 in the receiving member 130, a front end portion thereof abuts the receiving seat section 132 from the rear, and a rear end portion thereof abuts the cap wall 152 from the front. Accordingly, in the reservoir cylinder 90, the coil spring 160 biases the reservoir plunger 110 forward using an elastic recovering force thereof. Accordingly, the closing wall 122 closes the communication hole 95 in a state in which the communication hole 95 is sealed by biasing from the coil spring 160 as described above.

Note that a position of the reservoir plunger 110 when the closing wall 122 closes the communication hole 95 is the most advanced position. Accordingly, when the reservoir plunger 110 is disposed at the most advanced position, the reservoir cylinder 90 accommodates almost no liquid, and the communication hole 95 is blocked.

Figure 4:
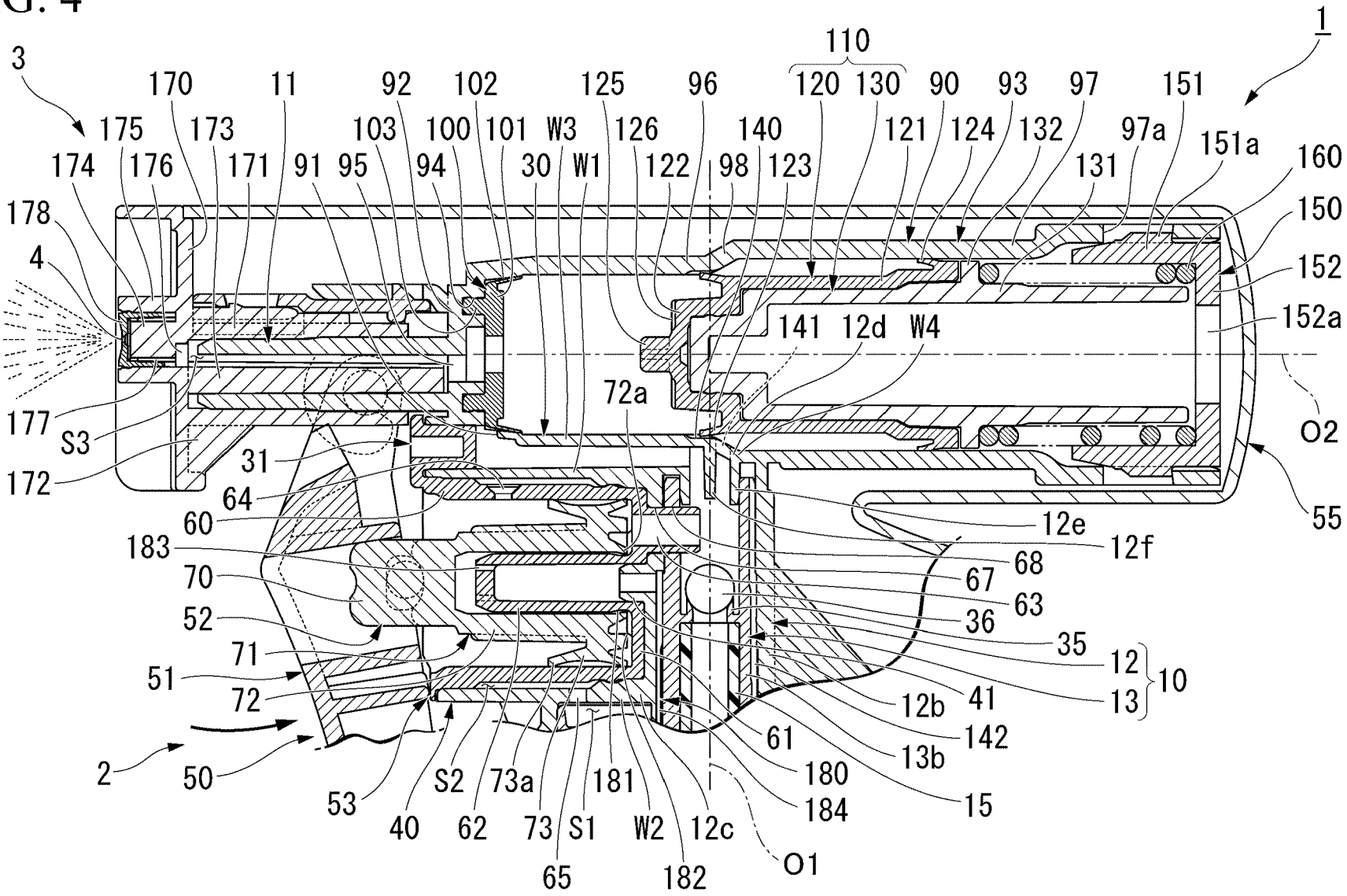
FIG. 4 is a longitudinal cross-sectional view showing a state in which a trigger is pulled rearward from a state shown in FIG. 3 to perform continuous spray.

On the other hand, as shown in FIG. 4, the position of the reservoir plunger 110 when the rear end portion of the receiving tube 131 abuts or approaches the cap wall 152 according to rearward movement of the reservoir plunger 110 is the most retracted position. Accordingly, when the reservoir plunger 110 is disposed at the most retracted position, the liquid is maximally accommodated in the reservoir cylinder 90.

As shown in FIGS. 1 and 3, the ejection barrel 11 extends forward from the front wall section 92 of the reservoir cylinder 90, and the liquid in the vertical supply pipe 10 is guided to the ejection hole 4. The ejection barrel 11 is disposed such that a central axis thereof is located below the axis O2 of the reservoir cylinder 90. The inside of the ejection barrel 11 comes in communication with the inside of the vertical supply pipe 10 through the communication hole 95, the inside of the reservoir cylinder 90, the supply hole 91 and the inside of the connecting tube section 30.

As shown in FIGS. 1 to 3, the ejector main body 2 further includes the trigger 51 extending downward from the ejection barrel 11 and disposed in front of the vertical supply pipe 10 to be swingable (movable) rearward while being biased forward, a main piston 52 linked to swinging of the trigger 51 and moved in the forward/rearward direction, the main cylinder 53 having the inside that is pressurized and decompressed according to movement of the main piston 52, an elastic plate section 54 configured to bias the trigger 51 forward, and a cover body 55 configured to cover all of the vertical supply pipe 10, the ejection barrel 11 and the reservoir cylinder 90 in at least the upward direction and the leftward/rightward direction.

The trigger 51, the main piston 52, the main cylinder 53 and the elastic plate section 54 constitute a trigger mechanism 50 configured to cause the liquid to flow from the inside of the vertical supply pipe 10 toward the ejection hole 4 through the inside of the ejection barrel 11 according to rearward swinging of the trigger 51.

The main cylinder 53 includes an outer tube section 60 that opens forward, a rear wall section 61 configured to close a rear opening section of the outer tube section 60, and a piston guide 62 protruding forward from a central portion of the rear wall section 61 and having a topped tubular shape, a front end of which is closed. The inside of the main cylinder 53 is in communication with the inside of the vertical supply pipe 10 through a communicating tube (a communication section) 63. Further, the closing-off plug 31 is formed integrally with the main cylinder 53.

The outer tube section 60 is fitted into the tube section 40 for a cylinder. The inner circumferential surface of the tube section 40 for a cylinder and the outer circumferential surface of the outer tube section 60 come in close contact with each other at both ends in the forward/rearward direction. Meanwhile, an annular gap S2 is secured in an intermediate section, which is disposed between both ends in the forward/rearward direction, between the inner circumferential surface of the tube section 40 for a cylinder and the outer circumferential surface of the outer tube section 60.

A first ventilation hole 64 configured to bring the inside of the outer tube section 60 and the gap S2 in communication with each other is formed in the outer tube section 60. A second ventilation hole 65 configured to bring the gap S2 and the gap S1 defined between the flange section 12*c* of the outer tube 12 and the flange section 13*c* of the inner tube 13 in communication with each other is formed in the flange section 12*c* of the outer tube 12.

Further, a third ventilation hole 66 configured to bring the gap S1, the inside of the large diameter section 13*a* of the inner tube 13 and the inside of the mounting cap 14 in communication with each other is formed in the flange section 13*c* of the inner tube 13.

The communicating tube 63 protrudes rearward from the main cylinder 53. Specifically, the communicating tube 63 is formed on a portion of the rear wall section 61 of the main cylinder 53 disposed above the piston guide 62, and integrally passes through the outer tube 12 and the inner tube 13. Here, the communicating tube 63 is closely fitted into a first through-hole 67 formed in the outer tube 12, and closely fitted into a second through-hole 68 formed in the inner tube 13 through the first through-hole 67. Accordingly, the inside of the vertical supply pipe 10 and the inside of the main cylinder 53 come in communication with each other through the communicating tube 63.

The communicating tube 63 is formed to come in communication with a space of the inner tube 13 disposed between the seal tube section 12*e* and the ball valve 36. Accordingly, the inside of the main cylinder 53 comes in communication with the space of the inner tube 13 disposed between the seal tube section 12*e* and the ball valve 36 through the communicating tube 63. Accordingly, the ball valve 36 can be switched to bring the inside of the container body A and the inside of the main cylinder 53 in communication with each other and block the communication.

The ball valve 36 is a check valve that is closed to block communication between the inside of the container body A and the inside of the vertical supply pipe 10 during pressurization in the main cylinder 53, and that is opened to allow communication between the inside of the container body A and the inside of the vertical supply pipe 10 according to upward displacement during decompression in the main cylinder 53. Accordingly, during closing of the ball valve 36, communication between the inside of the container body A and the inside of the main cylinder 53 through the vertical supply pipe 10 is blocked, and during opening of the ball valve 36, communication between the inside of the container body A and the inside of the main cylinder 53 through the vertical supply pipe 10 is allowed.

In the drawings, the communicating tube 63 protrudes in the inner tube 13. Accordingly, a portion of the communicating tube 63 disposed in the inner tube 13 is locked to the ball valve 36 when the ball valve 36 is open, and further upward displacement of the ball valve 36 can be restricted.

However, the communicating tube 63 may not protrude in the inner tube 13. In this case, for example, further upward displacement of the ball valve 36 can be restricted using the restricting protrusion 12*f*.

The inside of the piston guide 62 is open rearward. A fitting tube section 41 protruding forward from the rear wall in the tube section 40 for a cylinder (the small diameter section 12*b* of the outer tube 12) is fitted into the piston guide 62 from behind.

The main piston 52 includes a columnar connecting section 70 connected to the trigger 51, and a piston tube 71 disposed behind the connecting section 70 and having a diameter larger than that of the connecting section 70, and is formed in a tubular shape that opens rearward as a whole.

Further, the main cylinder 53 and the main piston 52 are disposed in a common axis (not shown) extending in the forward/rearward direction.

The piston tube 71 includes a piston main body section 72 that opens rearward and into which the piston guide 62 is inserted, and a sliding tube section 73 protruding from a rear end portion of the piston main body section 72 outward in the radial direction and, for example, in sliding contact with the inner circumferential surface of the outer tube section 60.

The piston main body section 72 has an inner diameter that is slightly larger than an outer diameter of the piston guide 62. The inner circumferential surface of the piston main body section 72 and the outer circumferential surface of the piston guide 62 face each other with a slight gap in the radial direction of the piston tube 71.

An annular inner lip section (a lip section) 72*a* protruding from the piston main body section 72 inward in the radial direction and in close sliding contact with the outer circumferential surface of the piston guide 62 is formed on a rear end portion of the piston main body section 72. Accordingly, sealability is secured between the inner lip section 72*a* and the outer circumferential surface of the piston guide 62.

The sliding tube section 73 includes an outer lip section 73*a* formed in a tapered shape having a diameter that is gradually increased forward and rearward from a central section in the forward/rearward direction and disposed at both end portions in the forward/rearward direction. The outer lip section 73*a* comes in close sliding contact with the inner circumferential surface of the outer tube section 60. Accordingly, sealability is secured between an outer lip section 74*a* and the inner circumferential surface of the outer tube section 60.

The connecting section 70 of the main piston 52 is connected to the trigger 51 via connecting shafts 86 (to be described below). Accordingly, the main piston 52 is biased forward by a biasing force of the elastic plate section 54 together with the trigger 51, and moved rearward and pushed into the main cylinder 53 according to rearward swinging of the trigger 51.

When the trigger 51 is disposed at the frontmost swinging position (the frontmost moving position), the main piston 52 is disposed at a frontmost position corresponding thereto, and the sliding tube section 73 closes the first ventilation hole 64. When the main piston 52 is moved rearward by a predetermined extent from the frontmost position according to rearward swinging of the trigger 51, the sliding tube section 73 opens the first ventilation hole 64. Accordingly, the inside of the container body A comes in communication with the outside through the third ventilation hole 66, the second ventilation hole 65 and the first ventilation hole 64.

As shown in FIG. 2, the trigger 51 includes a main plate member 80 having a front surface curved in a concave shape recessed rearward when seen in a side view in the leftward/rightward direction, and a pair of side plate members 81 standing up rearward from left and right side edge portions of the main plate member 80.

A pair of connecting plates 82 extending upward to reach a side of the ejection barrel 11 and sandwiching the ejection barrel 11 therebetween in the leftward/rightward direction are formed on upper end portions of the pair of side plate members 81. Rotary shaft sections 83 protruding outward in the leftward/rightward direction are provided on the pair of connecting plates 82. The rotary shaft sections 83 pivotably support a bearing section provided in an upper plate member 84 (see FIG. 3) configured to cover the ejection barrel 11 from above. Accordingly, the trigger 51 is swingable about the rotary shaft sections 83 in the forward/rearward direction.

In the trigger 51, an opening section Ma passing through the main plate member 80 in the forward/rearward direction is formed, and a connecting tube 85 extending rearward from a circumferential edge portion of the opening section 51*a* is formed.

The pair of connecting shafts 86 protruding toward an inner side of the connecting tube 85 in the leftward/rightward direction are formed on a rear portion of the inner circumferential surface of the connecting tube 85. The connecting shafts 86 are inserted into a connecting hole formed in the connecting section 70 of the main piston 52. Accordingly, the trigger 51 and the main piston 52 are connected to each other.

The connecting portion 70 of the main piston 52 is connected to the connecting shafts 86 to be pivotable about the axis and movable in the upward/downward direction by a predetermined amount. Accordingly, the main piston 52 is movable forward and rearward in conjunction with swinging of the trigger 51 in the forward/rearward direction.

The elastic plate sections 54 formed in an arc shape protruding forward when seen in a side view in the leftward/rightward direction and extending below the ejection barrel 11 are formed integrally with left and right sides of the upper plate member 84. The elastic plate section 54 includes a pair of leaf springs formed in arc shapes concentric with each other and arranged forward and rearward when seen in a side view in the leftward/rightward direction.

In the pair of leaf springs, a leaf spring disposed on a front side is referred to as a main leaf spring 54*a*, and a leaf spring disposed on a rear side is referred to as a subsidiary leaf spring 54*b*.

Lower end portions of the main leaf spring 54*a* and the subsidiary leaf spring 54*b* are connected integrally with each other via a folded section 54*c* having an arc shape. A locking piece 54*d* protruding downward is formed on the folded section 54*c*, and the locking piece 54*d* is inserted into and engaged with a pocket section 81*a* formed in the side plate member 81 in the trigger 51 from above.

Accordingly, the elastic plate sections 54 bias the trigger 51 forward via the locking pieces 54*d* and the pocket sections 81*a*.

An upper end portion of the main plate member 80 of the trigger 51 abuts a lower end portion of a restricting wall 172 (to be described below) from behind due to biasing by the elastic plate section 54. Accordingly, the trigger 51 is positioned at the frontmost swinging position.

Further, when the trigger 51 is pulled rearward from the frontmost swinging position, the elastic plate section 54 is elastically deformed to move the folded section 54*c* rearward via the locking piece 54*d*. Here, in the elastic plate section 54, the subsidiary leaf spring 54*b* is more largely elastically deformed than the main leaf spring 54*a*.

Even when the trigger 51 is pulled rearward, the locking piece 54*d* maintains a state in which the trigger 51 is engaged with the pocket section 81*a* until arrival at the rearmost swinging position (the rearmost moving position) while being extracted upward from the pocket section 81*a*.

As shown in FIGS. 1 and 3, the nozzle member 3 includes a nozzle plate 170, a mounting tube 171, the restricting wall 172, an insertion section 173, a nozzle shaft section 174 and an enclosure tube 175, and is disposed in front of the ejector main body 2.

The nozzle plate 170 is disposed to cover a front end opening section of the ejection barrel 11 from the front.

The mounting tube 171 protrudes rearward from the nozzle plate 170, and is closely fitted onto the ejection barrel 11.

A connecting hole 176 is formed in the nozzle plate 170. The connecting hole 176 is disposed inside the mounting tube 171 when the nozzle plate 170 is seen in a plan view in the forward/rearward direction. When the lower end portion of the restricting wall 172 abuts the upper end portion of the main plate member 80 of the trigger 51 from the front, the trigger 51 is positioned at the frontmost swinging position.

The insertion section 173 protrudes rearward from the nozzle plate 170, and is inserted into the ejection barrel 11 from the front throughout substantially the entire length of the insertion section 173 the forward/rearward direction. Here, the insertion section 173 is inserted into the ejection barrel 11 to secure a slight gap S3 in an upper portion in an internal space of the ejection barrel 11. Accordingly, the spatial volume in the ejection barrel 11 can be reduced.

Further, the gap S3 is in communication with the connecting hole 176.

The nozzle shaft section 174 is disposed such that the central axis thereof is disposed slightly above the axis O2 of the reservoir cylinder 90. The enclosure tube 175 protrudes slightly forward from the nozzle shaft section 174. An annular flow passage 177 in communication with the connecting hole 176 is formed between the nozzle shaft section 174 and the enclosure tube 175.

A nozzle cap 178 in which the ejection hole 4 that opens forward is formed is mounted on the nozzle shaft section 174, and the flow passage 177 and the ejection hole 4 are in communication with each other. Accordingly, the inside of the reservoir cylinder 90 is in communication with the ejection hole 4 through the communication hole 95, the inside of the ejection barrel 11, the connecting hole 176 and the flow passage 177. That is, the communication hole 95 brings the inside of the reservoir cylinder 90 and the ejection hole 4 in communication with each other.

In the trigger type liquid ejector 1 configured as described above in detail, as shown in FIG. 2, when the main piston 52 is moved to a position deviated rearward from the frontmost position, a communication path 180 configured to bring the inside of the main cylinder 53 in communication with the inside of the container body A through a route different from a route via the inside of the communicating tube 63 is formed between the main piston 52 and the main cylinder 53.

The communication path 180 will be described in detail.

An annular recessed section 181 is formed on an outer circumferential surface in the rear end portion of the piston guide 62. Accordingly, when the main piston 52 is moved rearward from the frontmost position, the inner lip section 72*a* formed on the piston main body section 72 reaches the recessed section 181, and can be accommodated in the recessed section 181.

The recessed section 181 is not limited to the case in which it is formed in an annular shape as long as the recessed section 181 is recessed toward an inner side of the piston guide 62. For example, the recessed section 181 may be formed at one place on the outer circumferential surface of the piston guide 62, or may be formed at a plurality of places at intervals in the circumferential direction of the piston guide 62.

Further, in the embodiment, as shown in FIG. 4, the recessed section 181 is formed at a position corresponding to the inner lip section 72*a* in the radial direction of the piston guide 62 when the main piston 52 is moved to the rearmost position. Accordingly, when the main piston 52 is moved to the rearmost position, the inner lip section 72*a* is accommodated in the recessed section 181.

When the inner lip section 72*a* is accommodated in the recessed section 181, a slight gap is formed between the inner lip section 72*a* and the recessed section 181. Accordingly, the inside of the main cylinder 53 and the gap between the inner circumferential surface of the piston main body section 72 and the outer circumferential surface of the piston guide 62 can be in communication with each other through the gap between the inner lip section 72*a* and the recessed section 181.

A plurality of ribs 182 protruding forward and extending in the radial direction of the piston guide 62 are formed on the rear wall section 61 of the main piston 52 at intervals in the circumferential direction of the piston guide 62. The inner lip section 72*a* comes in contact with the plurality of ribs 182 from the front when the main piston 52 is moved to the rearmost position. Accordingly, the inside of the main cylinder 53 can easily come in communication with the gap between the inner lip section 72*a* and the recessed section 181 through the gap between the ribs 182 neighboring in the circumferential direction.

However, the ribs 182 are not essential components and may not be provided.

As shown in FIG. 2, a communicating opening section 183 passing through the front end wall of the piston guide 62 in the forward/rearward direction and bringing the inside of the piston main body section 72 and the inside of the piston guide 62 in communication with each other is formed in the front end wall of the piston guide 62.

In the drawings, the plurality of communicating opening sections 183 are formed at intervals in the circumferential direction of the piston guide 62. The communicating opening sections 183 come in communication with the gap between the inner circumferential surface of the piston main body section 72 and the outer circumferential surface of the piston guide 62, and come in communication with the inside of the fitting tube section 41 through the inside of the piston guide 62.

The communicating opening section 183 is not limited to the case in which the plurality of communicating opening sections 183 are formed, and for example, one communicating opening section 183 having a size of the same diameter as the inner diameter of the piston guide 62 may be formed.

A connecting passage 184 configured to bring the inside of the fitting tube section 41 in communication with the inside of the third ventilation hole 66 is formed in a front portion of a space between the inner circumferential surface of the small diameter section 12*b* of the outer tube 12 and the outer circumferential surface of the small diameter section 13*b* of the inner tube 13 in the vertical supply pipe 10.

Accordingly, the inside of the main cylinder 53 and the inside of the container body A can come in communication with a route, which is different from the route via the inside of the communicating tube 63, through a space between the inner lip section 72*a* and the recessed section 181, a gap between the inner circumferential surface of the piston main body section 72 and the outer circumferential surface of the piston guide 62, the inside of the communicating opening section 183, the inside of the piston guide 62 and the inside of the connecting passage 184.

Accordingly, the space between the inner lip section 72*a* and the recessed section 181, the gap between the inner circumferential surface of the piston main body section 72 and the outer circumferential surface of the piston guide 62, the inside of the communicating opening section 183, the inside of the piston guide 62 and the inside of the connecting passage 184 functions as the communication path 180.

(Action of Trigger Type Liquid Ejector)

Next, the case in which the trigger type liquid ejector 1 configured as described above will be described.

Note that the respective parts of the trigger type liquid ejector 1 are filled with a liquid by a plurality of times of operations of the trigger 51, and the liquid can be suctioned from the vertical supply pipe 10.

In a state shown in FIG. 1, when the trigger 51 is pulled rearward against a biasing force of the elastic plate section 54, as shown in FIG. 4, the main piston 52 is moved rearward from the frontmost position according to rearward movement of the trigger 51, and therefore the inside of the main cylinder 53 can be pressurized. Accordingly, the liquid in the main cylinder 53 can be supplied to the inner tube 13 of the vertical supply pipe 10 through the communicating tube 63. Then, the liquid supplied to the inner tube 13 pushes down the ball valve 36 to close the ball valve 36, is supplied to the supply hole 91 through the connecting tube section 30, and pushed up the reservoir valve 102 to open the reservoir valve 102.

Accordingly, the liquid can be supplied into the reservoir cylinder 90, and the inside of the reservoir cylinder 90 can be pressurized. Accordingly, the pressure of the liquid supplied into the reservoir cylinder 90 can be increased, and the reservoir plunger 110 can be moved rearward from the most advanced position against biasing of the coil spring 160. In the early stage when the liquid starts to be introduced into the reservoir cylinder 90, the liquid enters the concave groove 126. For this reason, the reservoir plunger 110 is easily moved rearward.

When the reservoir plunger 110 is moved rearward, the front end surface of the closing wall 122 is separated from the rear end surface of the valve base section 101 to open the valve, and the communication hole 95 can be open. Accordingly, the liquid having an increased pressure can be introduced into the ejection hole 4 through the communication hole 95, the inside of the ejection barrel 11, the connecting hole 176 and the flow passage 177, and the liquid can be injected forward from the ejection hole 4.

In addition, at the same time, as described above, the reservoir plunger 110 can be moved rearward.

In this way, whenever an operation of pulling the trigger 51 rearward is performed, the liquid can be injected from the ejection hole 4, and the reservoir plunger 110 can be moved rearward to store (fill) the liquid in the reservoir cylinder 90.

When the reservoir plunger 110 is moved rearward, since the coil spring 160 is elastically compressed and deformed, a biasing force (a thrust force) that is directed forward can be applied to the reservoir plunger 110.

After that, when the operation of pulling the trigger 51 is stopped and the trigger 51 is released, since the trigger 51 is biased forward to return to its original position by the elastic recovering force of the elastic plate section 54, the main piston 52 is moved back forward through the main cylinder 53 in conjunction with the movement of the trigger 51. For this reason, since the pressure in the main cylinder 53 can be decompressed to become a negative pressure lower than the pressure in the container body A, the liquid in the container body A can be suctioned into the vertical supply pipe 10.

Then, the newly suctioned liquid pushes up the ball valve 36 to open the valve, and is introduced into the main cylinder 53 through the inside of the communicating tube 63. Accordingly, the liquid can be provided upon the next injection.

Here, the reservoir valve 102 is closed, and an upward moving distance of the ball valve 36 is restricted by a part of the communicating tube 63 protruding in the inner tube 13.

Then, when an operation of the trigger 51 is stopped after filling the inside of the main cylinder 53 with the liquid by repeating the operation of pulling the trigger 51 rearward, supply of the liquid into the reservoir cylinder 90 through the inside of the vertical supply pipe 10 and the inside of the connecting tube section 30 is stopped, and the reservoir plunger 110 starts to move forward toward the most advanced position (move back toward the other side in the axial direction) due to an elastic recovering force of the coil spring 160. Here, outflow of the liquid into the connecting tube section 30 from the inside of the reservoir cylinder 90 is restricted by the reservoir valve 102.

Accordingly, the liquid remained in the reservoir cylinder 90 can be introduced into the ejection hole 4 through the communication hole 95, the inside of the ejection barrel 11, the connecting hole 176 and the flow passage 177, and the liquid can be continuously injected forward through the ejection hole 4.

In this way, the liquid can be injected not only when the operation of pulling the trigger 51 rearward is performed but also when the trigger 51 is not operated, and continuous injection of the liquid can be performed.

In particular, according to the trigger type liquid ejector 1 of the embodiment, when the main piston 52 is moved rearward inside the main cylinder 53 to be disposed at the rearmost position according to the operation of the trigger 51, as shown in FIG. 4, the inner lip section 72*a* of the main piston 52 reaches the recessed section 181 of the piston guide 62 and is accommodated in the recessed section 181. Accordingly, the inside of the main cylinder 53 and the inside of the container body A can be in communication with each other through the communication path 180.

Accordingly, even when air is contained in the liquid suctioned into the main cylinder 53 from the inside of the container body A through the inside of the vertical supply pipe 10 and the inside of the communicating tube 63, the air can be mainly discharged from the inside of the main cylinder 53 according to rearward movement of the main piston 52, and the air can escape to the inside of the container body A through the communication path 180.

For this reason, the inside of the main cylinder 53 can be reliably decompressed to the extent that the air is discharged according to forward recovery movement of the main piston 52 after that. Accordingly, the liquid from the container body A can be efficiently suctioned into the main cylinder 53, the liquid can be efficiently supplied into the reservoir cylinder 90 according to the operation of the trigger 51 after that, and the inside of the reservoir cylinder 90 can be rapidly pressurized.

Accordingly, when the trigger 51 is operated first from an unused state, some of the air in the main cylinder 53 can be discharged into the container body A through the communication path 180 according to the operation of the trigger 51. Accordingly, the liquid suctioned from the inside of the container body A can be stored in the main cylinder 53 while efficiently discharging the air in the main cylinder 53, and preparation before use can be rapidly completed by performing priming a small number of times.

In addition, after completion of the above-mentioned preparation, since the inside of the reservoir cylinder 90 can be efficiently filled with the liquid by the operation of the trigger 51, continuous injection of the liquid can be securely and rapidly performed while avoiding (minimizing) injector errors, and appropriate injection performance can be obtained.

Since the inside of the main cylinder 53 can be securely decompressed as described above, reduction in number of priming times, avoidance of injection errors, and so on, can be achieved, and the trigger type liquid ejector 1 with high quality that can be easily used and having improved convenience can be obtained.

In particular, when the main piston 52 is moved from the frontmost position to the rearmost position, since the inner lip section 72*a* is accommodated in the recessed section 181, the air can be discharged from the inside of the main cylinder 53 in the final stage while substantially the entire liquid in the main cylinder 53 is supplied into the vertical supply pipe 10. Accordingly, both of appropriate supply of the liquid into the vertical supply pipe 10 from the inside of the main cylinder 53 and appropriate discharge of the air from the inside of the main cylinder 53 can be more stably and reliably performed. Accordingly, avoidance of injector errors, reduction in number of priming times, and so on, can be more efficiently exhibited.

Further, during continuous injection of the liquid, the pressure in the reservoir cylinder 90 may be efficiently increased, and the reservoir plunger 110 may be rapidly moved rearward. For this reason, for example, the pressure in the main cylinder 53, the pressure in a portion in the vertical supply pipe 10 disposed above the ball valve 36, and the pressure in the connecting tube section 30 may be efficiently increased by the operation of the trigger 51, and the liquid having the increased pressure may be efficiently supplied into the reservoir cylinder 90.

Accordingly, for example, a tapered pipe may be used as the pipe 15 configured to suction the liquid from the inside of the container body A. In this case, the liquid is suctioned while efficiently increasing the pressure in the main cylinder 53, the pressure in the portion in the vertical supply pipe 10 disposed above the ball valve 36, and the pressure in the connecting tube section 30, which leads to rapid continuous injection.

Here, it may be considered a case in which decompression in the main cylinder 53 is insufficient or decompression is not performed during use. The cause may be, for example, a case in which bubbles occur in the main cylinder 53, a case in which a forward biasing force of the reservoir plunger 110 is strong, or the like.

However, according to the embodiment, for example, even when bubbles occur in the main cylinder 53 during use, the bubbles can be discharged from the inside of the main cylinder 53 into the container body A through the communication path 180 by disposing the main piston 52 at the rearmost position. Accordingly, when the inside of the main cylinder 53 is decompressed according to forward recovery movement of the main piston 52 after that, the liquid can be suctioned into the main cylinder 53 from the inside of the container body A to an extent of a volume occupied by the discharged bubbles. Accordingly, even when the bubbles occur, since the inside of the main cylinder 53 can be reliably decompressed and the inside of the reservoir cylinder 90 can be efficiently filled with the liquid, stable injection can be performed without causing injection errors such as a case in which injection cannot be performed due to occurrence of bubbles, or the like.

Note that, for example, even in the case in which bubbles occurs in the vertical supply pipe 10 disposed above the ball valve 36 or in the connecting tube section 30 in addition to the case of the bubbles occurred in the main cylinder 53, the bubbles can be finally discharged into the container body A while the bubbles is gradually drawn into the communication path 180, and the same effect can be exhibited.

In addition, during an operation of the trigger 51, since some of the pressure in the main cylinder 53 escapes into the container body A through the communication path 180, it is possible to prevent so-called "dripping" in which, for example, the pressure in the main cylinder 53 is excessively increased and thus, the liquid is unexpectedly injected from the ejection hole 4. Accordingly, good drainage can be achieved.

As described above, according to the trigger type liquid ejector 1 of the embodiment, the liquid can be injected not only when an operation of pulling the trigger 51 rearward is performed but also when the trigger 51 is not operated, and continuous injection of the liquid can be performed.

In particular, since the inside of the main cylinder 53 can be reliably decompressed, reduction in number of priming times, avoidance of injection errors, and so on, can be achieved, and it is possible to provide a trigger type liquid ejector 1 with high quality that can be easily used and having improved convenience. Further, for example, when a liquid containing surfactant or the like and in which bubbles easily occur is used, the trigger type liquid ejector 1 of the embodiment can be particularly suitably used.

In addition, since the communication hole 95 in communication with the ejection hole 4 and the supply hole 91 in communication with the inside of the ejection barrel 11 are formed in the reservoir cylinder 90 and the reservoir plunger 110 directly closes the communication hole 95 via the closing wall 122, a spatial volume of a route from the connecting tube section 30 to the reservoir cylinder 90 (an interior volume occupied by the route) can be easily reduced with slight restriction. Accordingly, when the trigger 51 is operated, the liquid can be immediately supplied into the reservoir cylinder 90 from the inside of the connecting tube section 30, the reservoir plunger 110 is easily immediately moved rearward by rapidly increasing the pressure in the reservoir cylinder 90. For this reason, the liquid can be rapidly injected, and operability can be improved.

In addition, since the closing wall 122 that functions as an accumulator valve is provided and the closing wall 122 directly closes the communication hole 95, it is possible to pressurize the liquid until the closing wall 122 opens the communication hole 95. Accordingly, the liquid can be prevented from being immediately injected from the ejection hole 4 by the operation of the trigger 51, and the liquid can be injected at an appropriate pressure (injection pressure). Accordingly, even in the case other than continuous injection, injection can be performed in an appropriate injection state by the operation of the trigger 51. In addition, for example, during storage or the like, since a flow of the low pressure liquid toward the ejection hole 4 can be restricted by the closing wall 122, leakage of the liquid from the ejection hole 4 can be effectively minimized. Further, since there is a need to separately provide a high pressure valve or the like, simplification of the configuration is easily achieved.

In addition, since the coil spring 160 is elastically deformed to accumulate a pressure by moving the reservoir plunger 110 rearward, the liquid can be injected in a pressurized state, and continuous injection in an appropriate injection state can be performed.

Further, when the liquid in the reservoir cylinder 90 is sprayed from the ejection hole 4, outflow of the liquid from the reservoir cylinder 90 into the connecting tube section 30 can be restricted by the reservoir valve 102. Accordingly, for example, the pressure of the liquid sprayed from the ejection hole 4 through the ejection barrel 11 can be easily increased. For this reason, an injection form of the liquid can be maintained from starting of injection to stopping of the injection, and the liquid can be easily injected in various injection types.

In addition, when the reservoir plunger 110 is disposed at the most retracted position, the first lip section 123 of the reservoir plunger 110 is disposed on the communicating groove 140. Here, since the inside of the front tube section 96 is in communication with the collecting hole 141 through the communicating groove 140, the inside of the reservoir cylinder 90 and the inside of the container body A are in communication with each other through the collecting hole 141 and the collecting passage 142.

Accordingly, in a state in which the reservoir plunger 110 is sufficiently moved rearward, when the liquid is further introduced into the reservoir cylinder 90, the liquid can return into the container body A through the collecting hole 141 and the collecting passage 142. Accordingly, an excessive increase of the pressure in the reservoir cylinder 90 can be prevented.

Note that, during advance of the reservoir plunger 110, while the reservoir plunger 110 is moved to the most advanced position unless an operation of pulling the trigger 51 is performed again, the operation of pulling the trigger 51 may be repeated before that.

In this case, the reservoir plunger 110 moves backward gradually as a whole while repeatedly moving backward and forward. Accordingly, the liquid can be gradually stored in the reservoir cylinder 90. Then, the liquid can be continuously injected for a long time until the reservoir plunger 110 moves from the most retracted position to the most advanced position by, for example, moving the reservoir plunger 110 to the most retracted position.

Note that, the technical spirit of the present invention is not limited to the embodiment, and various modifications may be made without departing from the spirit of the present invention.

For example, in the embodiment, a mechanism configured to lock an operation of the trigger 51 or a switching member disposed in front of the ejection hole 4 and configured to switch an injection form (for example, a fog shape, a bubble shape, or the like) of the liquid may be further provided.

In addition, while the trigger 51 is swingable rearward, a rearward moving type of the trigger 51 can be appropriately employed. For example, the trigger 51 may be slidable rearward.

In the embodiment, the connecting tube section 30 and the reservoir cylinder 90 may not include the common partition wall W3, or vertical supply pipe 10 and the reservoir cylinder 90 may not include the common partition wall W4. Further, in the embodiment, the connecting tube section 30 and the closing-off plug 31 are not essential and may not be provided.

In the embodiment, while the reservoir plunger 110 is moved rearward according to supply of the liquid into the reservoir cylinder 90, it may not be limited to the case.

For example, a configuration in which the reservoir plunger 110 is moved forward according to supply of the liquid into the reservoir cylinder 90 may also be employed.

Further, a configuration in which the axis O2 of the reservoir cylinder 90 extends in a direction different from the forward/rearward direction and the reservoir plunger 110 is moved in the axial direction along the axis O2 (a direction different from the forward/rearward direction) may also be employed.

In the embodiment, while the reservoir plunger 110 is recovered and moved using an elastic recovering force (a biasing force) of the coil spring 160, it is not limited to the case. For example, in addition to the biasing force of the coil spring 160 or instead of the biasing force, a configuration disclosed below may also be employed.

That is, a configuration in which the ejector main body 2 includes a negative pressure plunger connected to the reservoir plunger 110 and linked to movement of the reservoir plunger 110 in the axial direction, and a negative pressure cylinder extending in the axial direction, configured to block communication between the other end opening of the reservoir plunger 110 in the axial direction and the outside, and in which the negative pressure plunger is accommodated to be movable toward one side in the axial direction may be employed.

In this case, the reservoir plunger 110 is moved toward one side in the axial direction together with the negative pressure plunger in the negative pressure cylinder according to supply of the liquid into the reservoir cylinder 90. Here, a closed space in the negative pressure cylinder disposed on the other side than the negative pressure plunger in the axial direction becomes a negative pressure. Accordingly, a biasing force toward the other side in the axial direction is applied to the negative pressure plunger and the reservoir plunger 110. As a result, the reservoir plunger 110 can be recovered and moved using the biasing force.

As the above-mentioned configuration is employed, when the reservoir plunger 110 is recovered and moved, since the negative pressure in the negative pressure cylinder is used, for example, even though the biasing force applied from the other member such as the coil spring 160 or the like is not used, the reservoir plunger 110 can be recovered and moved. Accordingly, a thrust force can be applied to the reservoir plunger 110 while achieving simplification of the structure. Moreover, since the coil spring 160 that is generally formed of a metal material is not used, the trigger type liquid ejector 1 can also be formed of a synthetic resin material only.

In the embodiment, while the ejection barrel 11 extends forward from the reservoir cylinder 90, it is not limited to the case. In addition, while the supply hole 91 and the communication hole 95 are separately formed, for example, the supply hole 91 may function as the communication hole 95. Further, the connecting tube section 30 and the closing-off plug 31 are not essential and may not be provided.

In the embodiment, while the piston guide 62 is formed in a topped tubular shape, it is not limited to the case, and for example, the piston guide 62 may be formed in a solid columnar shape. In this case, a communication opening may be formed throughout the length of the piston guide 62, and may be in communication with the inside of the fitting tube section 41. Even in this case, the same effect can be achieved.

In addition, while the connecting passage 184 is formed in the vertical supply pipe 10 between the inner circumferential surface of the small diameter section 12*b* of the outer tube 12 and the outer circumferential surface of the small diameter section 13*b* of the inner tube 13 and the inside of the fitting tube section 41 and the inside of the third ventilation hole 66 are in communication with each other through the connecting passage 184, it is not limited to the case.

For example, the connecting passage 184 may be in communication with the vertical supply pipe 10, and the inside of the fitting tube section 41 and the inside of the container body A may be in communication with each other through the inside of the connecting passage 184 and the inside of the vertical supply pipe 10. Even in this case, the inside of the main cylinder 53 and the inside of the container body A can be in communication with each other through a route different from a route via the communicating tube 63.

Further, in the embodiment, while the inside of the main cylinder 53 and the inside of the container body A are in communication with each other through, mainly, a space between the inner circumferential surface of the piston main body section 72 and the outer circumferential surface of the piston guide 62, and the communication path 180 via the inside of the piston guide 62, it is not limited to the case.

For example, the inside of the main cylinder 53 and the inside of the container body A may be in communication with each other through a communication path via a space between the outer circumferential surface of the main piston 52 (specifically, the outer circumferential surface of the sliding tube section 73) and the inner circumferential surface of the main cylinder 53 (specifically, the inner circumferential surface of the outer tube section 60). In this case, for example, the annular recessed section 181 may be formed in the inner circumferential surface of the outer tube section 60 on the side of the rear end portion, and when the main piston 52 is disposed at the rearmost position, the outer lip section 73*a* may be accommodated in the recessed section 181. Even in this case, the same effect can be achieved. Further, in this case, the piston guide 62 may also be omitted.

However, when the communication path 180 is formed as described in the embodiment, since the inside of the piston guide 62 can be effectively used, it is preferably to easily form the communication path 180. In addition, since movement of the main piston 52 can be guided using the piston guide 62, the main piston 52 can be easily smoothly moved with less rattling. Accordingly, operability of the trigger 51 can be improved, and injection of the liquid can be smoothly performed.

INDUSTRIAL APPLICABILITY

According to the present invention, since an inside of a main cylinder can be reliably decompressed, reduction in number of priming times, avoidance of injection errors, and so on, can be achieved, and it is possible to provide a trigger type liquid ejector with high quality that can be easily used and having improved convenience.

REFERENCE SIGNS LIST

A Container body
O2 Central axis of reservoir cylinder
1 Trigger type liquid ejector
2 Ejector main body
3 Nozzle member
4 Ejection hole
10 Vertical supply pipe
11 Ejection barrel
36 Ball valve (first check valve)
50 Trigger mechanism
51 Trigger
52 Main piston
53 Main cylinder
62 Piston guide
63 Communicating tube (communication section)

72*a* Inner lip section (lip section of main piston)
90 Reservoir cylinder
102 Reservoir valve (second check valve)
110 Reservoir plunger
122 Closing wall (accumulator valve)
180 Communication path

The invention claimed is:

1. A trigger type liquid ejector comprising:

an ejector main body mounted on a container body in which a liquid is accommodated; and a nozzle member disposed in front of the ejector main body and in which an ejection hole configured to inject the liquid is formed, wherein the ejector main body includes:

a vertical supply pipe extending in an upward/downward direction and configured to suction the liquid in the container body;

an ejection barrel disposed in front of the vertical supply pipe and configured to guide the liquid in the vertical supply pipe into the ejection hole; and a trigger mechanism having a trigger disposed in front of the vertical supply pipe to be movable rearward in a state where the trigger is biased forward, the trigger mechanism being configured to cause the liquid to flow from an inside of the vertical supply pipe toward the ejection hole through an inside of the ejection barrel according to rearward movement of the trigger, wherein the trigger mechanism includes:

a main piston configured to move forward and rearward in conjunction with movement of the trigger; and a main cylinder inside of which is compressed and decompressed according to movement of the main piston, the inside of the main cylinder coming in communication with the inside of the vertical supply pipe through a communication section, wherein the ejector main body includes:

a reservoir cylinder into which the liquid passing through the inside of the vertical supply pipe is supplied according to rearward movement of the trigger;

a reservoir plunger disposed in the reservoir cylinder to be movable in an axial direction along a central axis thereof, and moving to one side in the axial direction according to supply of the liquid into the reservoir cylinder while being biased toward the other side;

a first check valve configured to block communication between an inside of the container body and the inside of the vertical supply pipe when the inside of the main cylinder is pressurized, and allow communication between the inside of the container body and the inside of the vertical supply pipe when the inside of the main cylinder is decompressed; and a second check valve configured to allow communication between the ejection hole and the inside of the vertical supply pipe when the inside of the main cylinder is pressurized, and block communication between the ejection hole and the inside of the vertical supply pipe when the inside of the main cylinder is decompressed, and a communication path is provided between the main piston and the main cylinder, the communication path being configured to bring the inside of the main cylinder in communication with the inside of the container body when the main piston is moved to a position deviated rearward from a frontmost position.

2. The trigger type liquid ejector according to claim 1, wherein the ejector main body includes an accumulator valve configured to pressurize the liquid, and open to supply the pressurized liquid toward the ejection hole when a pressure of the liquid reaches a predetermined value.

3. The trigger type liquid ejector according to claim 1, wherein a piston guide with which the main piston closely slides is formed in the main cylinder, and the communication path is configured to bring the inside of the main cylinder in communication with the inside of the container body through a space between an inner circumferential surface of the main piston and an outer circumferential surface of the piston guide and an inside of the piston guide.

4. The trigger type liquid ejector according to claim 3, wherein a lip section in close sliding contact with the outer circumferential surface of the piston guide is formed on the main piston, a recessed section recessed toward an inner side of the piston guide and configured to accommodate the lip section is formed in a portion of the outer circumferential surface of the piston guide facing the lip section in a radial direction of the piston guide when the main piston is disposed at a rearmost position, and the communication path is configured to bring an inside of the main piston in communication with the inside of the piston guide through a gap between the lip section and the recessed section.

* * * * *